United States Patent [19]

Loggins

[11] 3,982,401

[45] Sept. 28, 1976

[54] MARINE STRUCTURE WITH DETACHABLE ANCHOR

[75] Inventor: John T. Loggins, Metairie, La.

[73] Assignee: Texaco Inc., New York, N.Y.

[22] Filed: Apr. 2, 1975

[21] Appl. No.: 564,522

[52] U.S. Cl. ..... 61/93; 166/.5; 175/7

[51] Int. Cl.[2] ..... B63B 35/44

[58] Field of Search ..... 61/46.5, 46; 114/.5 D, 114/.5 F, 206; 175/7, 8; 166/.5

[56] References Cited

UNITED STATES PATENTS

| | | | |
|---|---|---|---|
| 2,908,141 | 10/1959 | Marsh | 61/46.5 X |
| 3,086,368 | 4/1963 | Popper | 61/46.5 |
| 3,255,627 | 6/1966 | Doig et al. | 114/.5 D |
| 3,429,133 | 2/1969 | Hauber | 61/46.5 |
| 3,486,343 | 12/1969 | Gibson et al. | 61/46.5 |
| 3,550,385 | 12/1970 | Lowd et al. | 61/46.5 |

*Primary Examiner*—Jacob Shapiro

*Attorney, Agent, or Firm*—Thomas H. Whaley; Carl G. Ries; Robert B. Burns

[57] ABSTRACT

Semisubmersible marine structure for operation in offshore waters, comprising a work deck which is supported by a buoyant substructure. The latter includes a separably connected anchor unit which can be controllably lowered to the floor of the offshore site and thereafter weighted, to regulate the position of the floatable structure. Tensioning lines extending between the anchor and the structure draw the latter downward below its normal floating disposition. Similarly, outboard anchor lines are actuated to locate the structure laterally with respect to its position over a drill site.

7 Claims, 6 Drawing Figures

MARINE STRUCTURE WITH DETACHABLE ANCHOR

BACKGROUND OF THE INVENTION

The concept of tension leg marine structures, as well as semisubmersible platforms has gained in popularity in offshore waters, particularly in relatively deep waters. Although the piled or fixed type structure is applicable to water depths up to approximately 1,000 feet, the cost of a fixed platform of such a magnitude can become excessive.

The tension leg type unit hereinafter described embodies many of the desirable features of a fixed platform. Primarily, it is subject to a minimal amount of movement in response to wind and wave conditions. Further, the structure functions well to maintain a static positioning stance over a desired drilling site.

This positioning is normally achieved through the use of tension lines extending between the buoyant platform and the anchor section. Alternately, a series of such tensioned lines can be further supplemented through outboard anchoring lines which radiate from the platform to maintain its lateral orientation.

A further desirable feature of any offshore unit is its capability to directionally drill a well to reach a desired reservoir. Such capability provides any marine platform with a wider degree of versatility in that it can readily form a plurality of multi-directional wells from a single site. This feature in a marine structure is of particular benefit in the instance of shallow subterranean reservoirs. The latter are often of insufficient depth to whipstock a drill string. The only suitable method therefore to reach the shallow pool is by directional drilling.

The presently described tension leg unit includes essentially a support or understructure having a buoyant base or foundation at the lower end. A plurality of controlled buoyancy support legs extend therefrom in an upward direction. A deck carried at the upper end of the respective legs is maintained a desired although variable distance beyond the water's surface. Said deck carries the normal complement of equipment and accessories for drilling, producing, storing or the like.

The buoyant base comprises a first segment which is firmly fixed to the lower end of the platform, and a second or anchor segment which cooperates with said first segment but is detachably connected thereto.

While the structure is being floated to a drilling or working site, the anchor segment is in the raised position being fixedly attached to the base. However, at location the anchor is detached from the base, weighted, and controllably lowered to the ocean floor. A plurality of tension cables or chains extending between the anchor and the base are adjusted to draw the structure downward against its natural buoyancy. Simultaneously, the buoyancy of the base is regulated to afford a desired upward or buoying force to the structure.

Outrigger anchoring lines are disposed about the marine platform at sufficient intervals to provide it with the necessary degree of stability for drilling, and to permit adjusting the structure with respect to its position over the anchor.

DESCRIPTION OF THE DRAWINGS

Referring to FIG. 1, marine structure 10 comprises in its primary form, a foundation or base member 11 having buoyancy capabilities by virtue of a plurality of compartments or tanks 12, and a buoyancy control system carried therein. The latter embodies a suitable pumping arrangement to either ballast or deballast foundation member 11 as needed.

Figure 1:
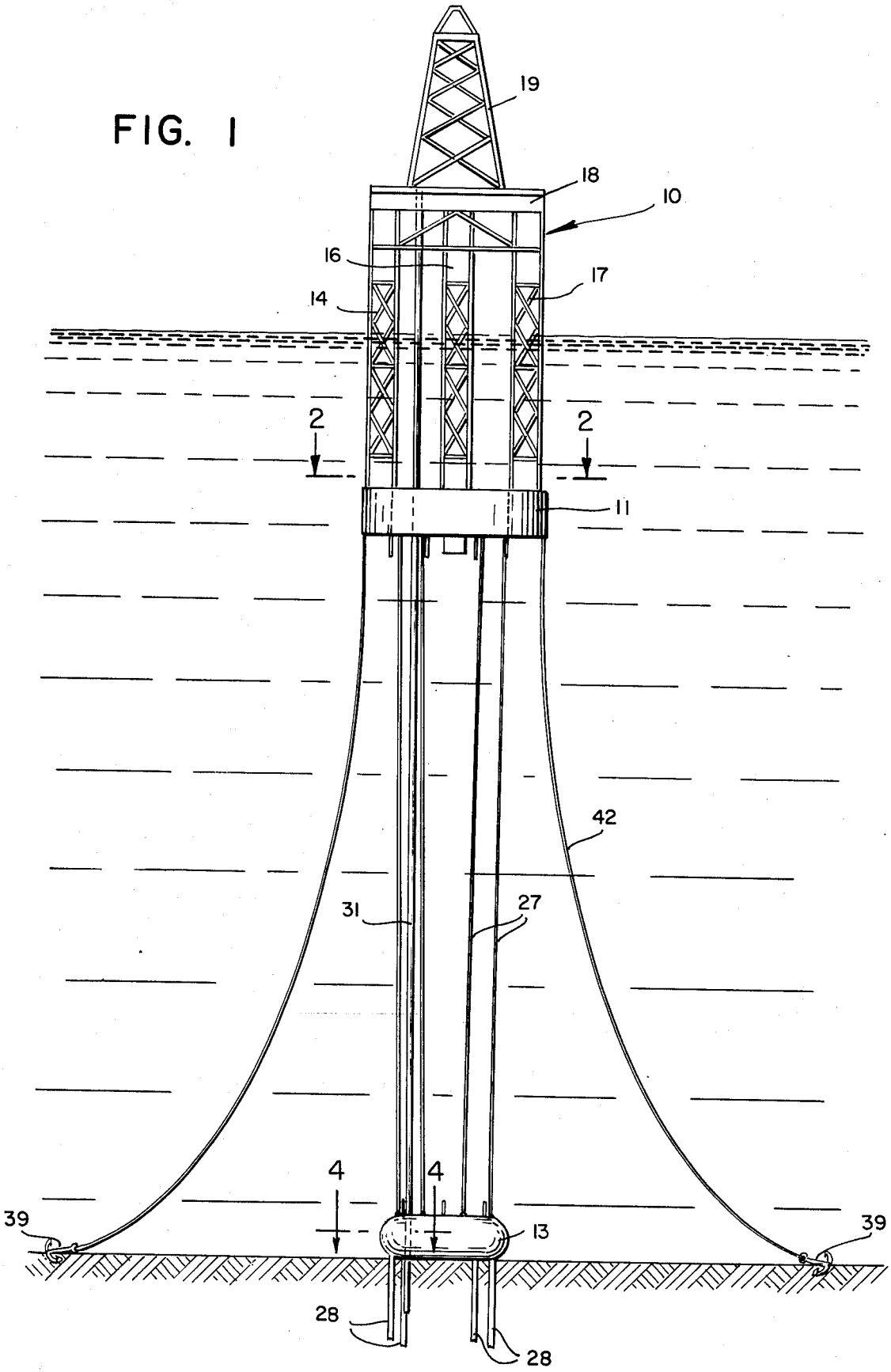
FIG. 1 is a vertical elevation of the instant platform anchored in the manner disclosed.
Figure 2:
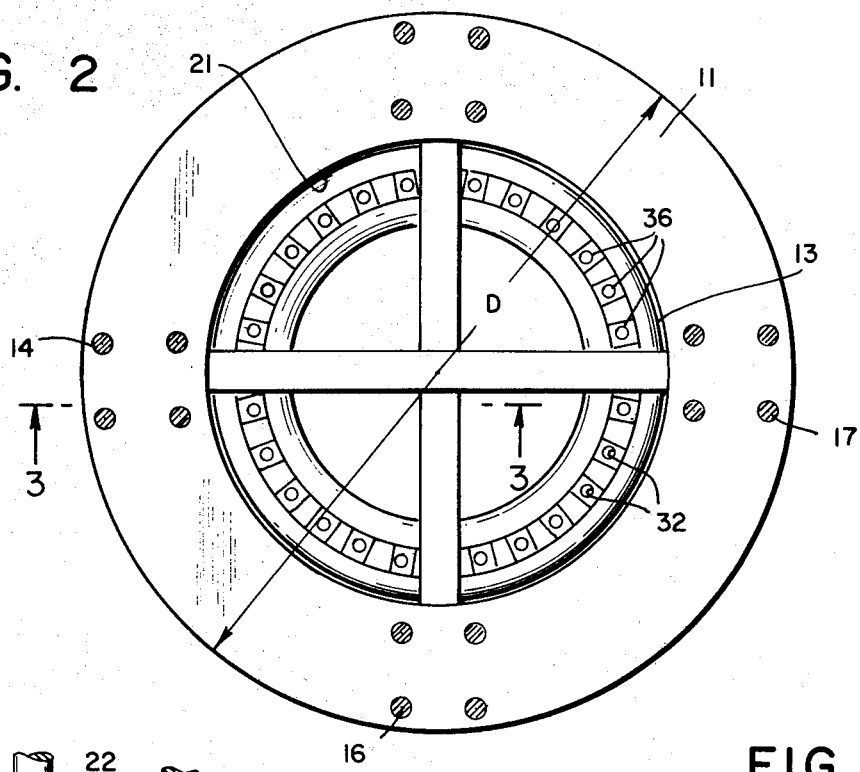
FIG. 2 is a cross sectional view on an enlarged scale taken along line 2—2 of FIG. 1.

Said member is removably connected to a similarly controlled anchor 13 which can be positioned either at the ocean floor as shown in FIG. 1, or raised into engagement with the base as shown in FIG. 2. In the latter position the entire structure can be transported or towed through the water. Preferably it is propelled by its own power to a desired working site.

A plurality of support legs 14, 16 and 17 are connected to and extend upwardly from foundation member 11. Said legs can be of the single member column form, or of the trussed shape shown in FIG. 1. Said legs may further have internal buoyancy tanks to stabilize the structure when in a semisubmerged condition.

The upper ends of the respective support legs 14, 16 and 17 are connected to working deck 18 usually positioned 50 to 60 feet above the water's surface to maintain operating equipment beyond the reach of the waves and spray.

While the marine structure 10 will be herein referred to as a drilling platform, it can understandably be utilized for any number of uses adapted to marine work such as a producing platform, storage facility, or merely a mooring for large tankers. In any event, when utilizd as a drilling platform the structure will embody a drilling derrick 19, draw works, crew's quarters and similar equipment not shown, necessary toward achieving a drilling function. Further, while not presently shown in detail, the three support legs 14, 16 and 17 can be interconnected by cross members and the like for mutual strength.

The support legs can comprise a simple cylindrical arrangement, a form often utilized in this type structure. As herein noted, they also embody buoyancy capabilities in the form of internal chambers mutually connected by a remote control system. In either instance the function of the buoyancy system is to regulate the stability and disposition of the structure during its various phases of operation.

Base member 11, as shown in FIG. 2, embodies a torus-like configuration comprising a sufficiently large outer diameter D to give the vessel floating capability and seaworthiness for those periods when it is being towed between locations. A central opening formed in the base 11 and extending vertically therethrough defines a cylindrical cavity 21 into which anchor member 13 is received when the latter is in the raised position.

Figure 3:
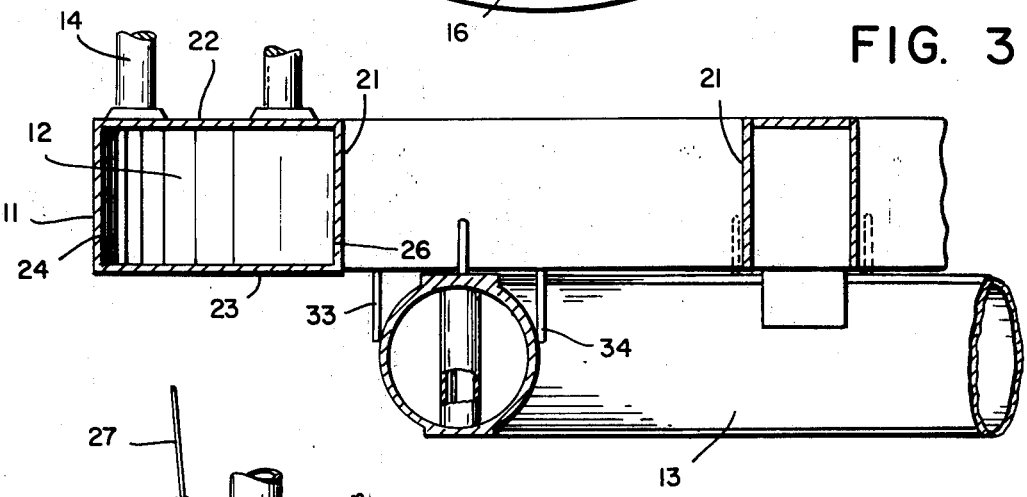
FIG. 3 is a cross sectional view taken along line 3—3 of FIG. 2.

Base member 11 as shown in FIGS. 2 and 3, comprises upper and lower panels 22 and 23, together with oppositely positioned peripheral walls 24 and 26 which define an open passage therethrough. Said passage is partitioned at convenient intervals to define discrete buoyancy compartments and individual tanks. Thus, the buoyancy tanks can be selectively regulated through water ballast or deballasting to permit the platform 11 to be lowered a desired depth into the water or to exert an upward pull on the tension cables 27 attached thereto.

Figure 4:
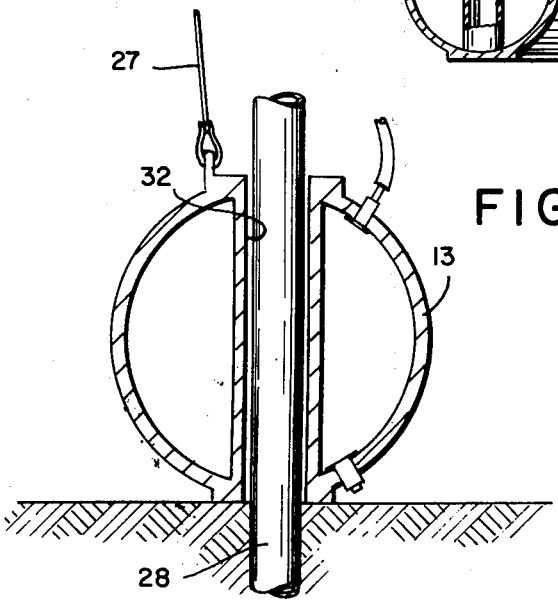
FIG. 4 is a cross sectional view on an enlarged scale taken along line 4—4 of FIG. 2.

Anchoring member 13 comprises a single unit shaped similarly to the cavity in base 11, i.e. in the shape of a torus. The latter as shown particularly in FIG. 4, is characterized by a generally circular cross section. This anchoring member can serve to house a manifold system or production system supplemental to a drilling or producing operation. The lower anchor member 13, when in the raised position is located by a plurality of guide arms or panels 33 and 34 extending downwardly from the base member 11.

Thus, while proceeding to an offshore location, anchor member 13 is firmly engaged with the platform base permitting the entire structure 10 to function as a floating vessel. At the drilling site, anchor member 13 is released from base 11, the buoyancy thereof is adjusted so that the anchor sinks toward the floor of the drilling site. Thereafter, it is guidably lowered by supporting cables 27 to the desired spot at the ocean floor.

To facilitate the placement of piles 28 and for positioning drill string conductors or guides 31, a plurality of elongated openings 32 extend transversely of the anchor member 13.

A sufficient number of said openings 32 are arranged in a substantially vertical disposition to receive anchoring piles 28 which are lowered from deck 18. Thus, as a pile 28 is lowered by derrick 19 or the like, its lower end is guided into an opening 32. Thereafter the pile, while being supported at the upper end, is driven into the substrate either by a deck mounted apparatus or by an underwater pile driver.

Figure 5:
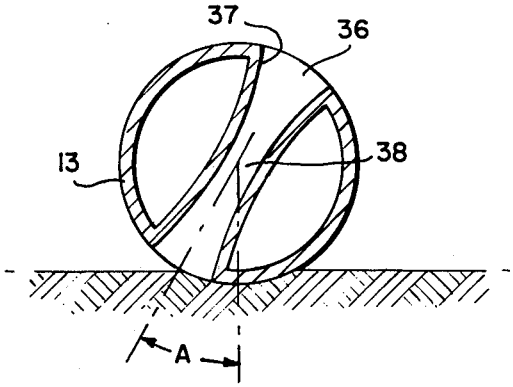
FIG. 5 is similar to FIG. 4.

Referring to FIG. 5, openings 36 are similarly arranged transversely of the anchor member 13 and are so disposed at varying angles to the vertical that drill string conductor 31 can be lowered from deck 18 and its direction determined by the alignment of openings 36. The generally conical, convergent surface at the upper end of said respective openings 36 tend to preclude or minimize binding of conductor 31 as it is lowered and driven into the substrate.

Figure 6:
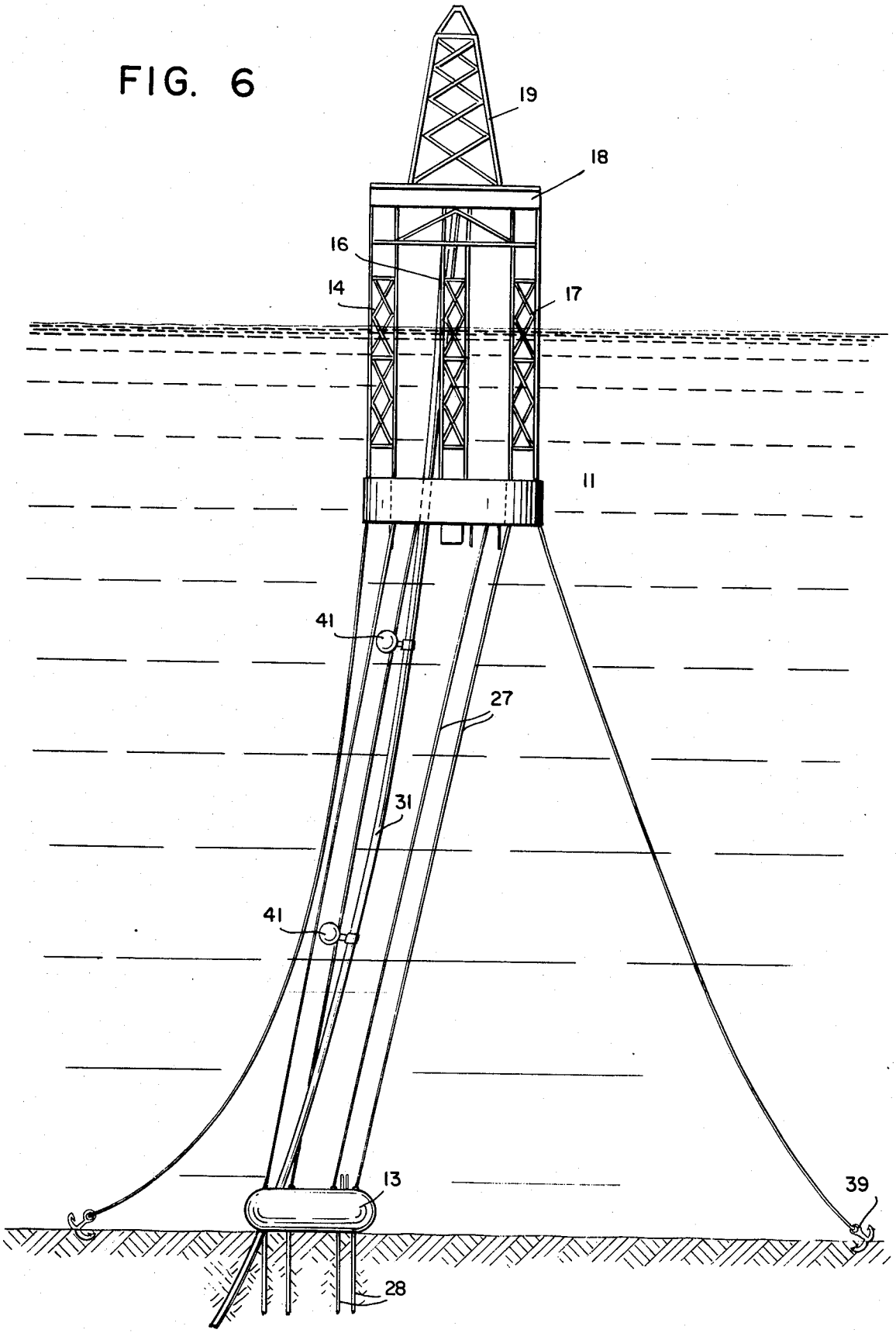
FIG. 6 is similar to FIG. 1 illustrating the marine platform displaced laterally from its positioning anchor.

Referring to FIG. 6, in accordance with the degree of deflection or deviation to which conductor 31 is subjected, means can be provided for supporting the latter between deck 18 and the ocean floor. For example, in deep water the combined weight of a drill string, together with the mud, will tend to bend conductor 31. Thus, the latter can be supported by buoyant means such as floats 41 spaced therealong, or by means depending from the platform deck so attached to the conductor to regulate its curvature.

The enlarged receptacles or openings 36 as above mentioned, are so arranged about anchor 13 to receive the lower end of a drill string conductor 31. Said openings will then direct the conductor to achieve a desired degree of deviation of the drill string as it is lowered through said conductor.

In one embodiment the registering openings 36 are directed outwardly an amount A with respect to the vertical axis of the anchor member 13. As noted, the tapered surface through which conductor 31 is guided, comprises a relatively wide opening 37 which terminates at a substantially narrowed opening 38, the latter, however, being sufficient to permit a conductor 31 to slide freely therethrough.

Operationally, a marine platform of the type contemplated is normally assembled at a shore installation such that the base 11 and anchor member 13 are initially joined through use of attaching cables 27 and the like. Thereafter, the buoyancy of said base 11 and anchaor member 13 are regulated such that the entire platform including work deck 18 is floated. In such position, the structure, whether self propelled or towed by a vessel, is brought to a desired offshore site.

Another member 13 is thereafter detached from base 11 and the buoyancy adjusted by ballasting with water. In such a condition anchor 13 will descend to the ocean floor, being guided thereto by the supporting cables 27. Piles are then lowered from deck 18 and guided into the respective openings 32 of the anchor member either automatically or by divers at the ocean floor.

With anchor member 13 firmly piled into place by the desired number of piles, it will function as a foundation for floating structure 10. By varying the tension on holding cables 27, and by regulating the buoyancy of the base 11, the entire structure 10 can be drawn downwardly into the water so that deck 18 is positioned a desired distance above the water's surface. In such condition the structure will be maintained in a relatively stable condition by virtue of the various tensioning cables 27.

As the floating structure 10 is acted on by moving water currents and surface winds, the entire unit will be displaced laterally. However, such movement is limited in view of the resisting tension applied by the respective anchoring cables 27. Further, there will be little or no vertical displacement of the platform as a result of rough water or wind conditions.

To stabilize and regulate lateral movement of the unit, a plurality of anchoring cables 42 are lowered from the platform base 11 to the ocean floor. These, as shown, are disposed in such a pattern about the center anchor 13 to be evenly spaced from the latter and preferably such that the lateral holding forces will be stabilized on all sides of the floating platform. Outboard anchors 39 are preferably embedded in a circular pattern about the center anchor member 13 and at a sufficient distance therefrom to assure proper holding capacity in accordance with the height of the platform 10 above the sea floor.

For the standard drilling procedure, a conductor 31 is lowered from the platform deck 18 and into one of the vertical openings 32 in the anchor member 13. With conductor 31 fastened into place, a drill string can be lowered by derrick structure 19 and being guided by the conductor 31, will enter the substrate at a point below anchor 13.

Ordinarily a drill string can be deviated to assure a desired direction in the usual manner, such as through whipstocking or the like. For relatively shallow reservoirs it is desirable that the drill string be deflected as soon as possible after entering the substrate, toward reaching the reservoir as quickly as possible.

In the present instance the deviating program is commenced by displacing the floating structure 10 a desired distance from its vertical position above the anchor 13. For this operation, drill string guide 31 can be initially lowered from the platform deck 18 and registered within biased guide openings 36.

With the lower end of said guide conductor 31 so retained, the platform 10 can then be displaced from its vertical alignment above anchor 13 to a lateral position. The supported conductor 31 will thereby assume a desired curvature in the direction in which the drill is to be progressed. This displacement of platform 10 is achieved by adjusting the tension in the respective anchoring cables or chains 42.

The degree of lateral displacement of structure 10 will be contingent on the depth of the water as well as on the capability of the conductor guide 31 to deflect a rotating drill string as the latter is lowered therethrough.

In any instance conductor 31 is aligned in such manner that it enters the substrate beneath the anchor 13 at a desired angle. Conductor 31 is thereafter embedded a sufficient distance such that the drill string will be directed toward its desired course immediately upon entering the substrate.

As herein mentioned, dependent on the depth of the water and the other operating conditions, the curved conductor 31 might require means for supporting it during the operation. This can be achieved through the facility of controllably buoyant floats or supports 41 positioned at the ocean surface or along the conductor. Thus, with a plurality of such spaced apart buoys sufficient support can be given to the curved drilling conductor 31 to regulate the curvature thereof.

Anchor 13 contains a number of guide openings 36 positioned a desired number of degrees from the vertical. Thus, a varying number of deviated wells can be drilled from a particular position of the platform deck 18. However, it is appreciated that the floating platform 10 can be adjusted as needed to accomplish the drilling of many wells, each being directed in a different direction as it enters the substrate.

Other modifications and variations of the invention as hereinbefore set forth may be made without departing from the spirit and scope thereof, and therefore, only such limitations should be imposed as are indicated in the appended claims.

I claim:

1. Method for commencing directional drilling of an underwater well from a buoyant tension leg marine structure which includes; a buoyant base having a deck holding well drilling equipment thereon, a first anchor at the ocean floor having a registration passage therein, cable means under tension, connecting said marine structure to said first anchor whereby to partially overcome the buoyancy of said structure and to establish a vertical position defined by a substantially vertical relationship between said anchor and said marine structure and second anchor means depending from said deck connected to discrete anchors disposed at the ocean floor and positioned radially outward from said first anchor, which includes the steps of;

laterally displacing said buoyant structure from its neutral position to establish a predetermined angle of inclination thereof with said first anchor, fixing said marine structure in said laterally displaced position, fixing the lower end of an elongated drill string conductor to said first anchor and the upper end thereof to said working deck in a position to receive a drill string from said drilling equipment.

2. In a floatable marine structure (10) capable of operating in offshore waters and including; a base (11), a working deck (18) spaced upwardly from the base to be floatably positioned at the water's surface, first anchor means (13) engaging the lower end of said marine structure and adapted to be positioned at the ocean floor, and tension cables (27) extending between said anchor means and said base for floatably positioning the latter at a desired water depth, said first anchor means (13) including; a body having a peripheral edge, means disposed on said body forming guide passages (36) having a sufficiently large opening to register the lower end of a drill guide conductor (31) therein, whereby to support the lower end of said drill guide conductor at a desired angle to the ocean floor during a drilling operation, and secondary anchor means connected to said marine structure including; a plurality of discrete anchors (39) spaced radially outward from said first anchor means (13), and cable means (42) depending from said deck (18) having one end connected to said discrete anchors (39) and the other end thereof operably connected to a cable adjusting means being operable to regulate the tension in selected of said cables, whereby to laterally displace said floating base (11) to a desired vertical orientation with respect to said anchor means (13).

3. In the apparatus as defined in claim 2, including a drill guide conductor (31) supported at said deck, extending downwardly therefrom and being registered in a guide passage (36).

4. In the apparatus as defined in claim 2, wherein said guide passage (36) includes an enlarged upper end to receive a drill guide conductor.

5. In the apparatus as defined in claim 2, including a plurality of guide passages disposed about the peripheral edge of said body.

6. In the apparatus as defined in claim 2, wherein said guide passages include an enlarged opening at the upper end thereof which is progressively constricted along at least a portion of the length thereof.

7. In the apparatus as defined in claim 2, wherein said means forming said guide passage includes; a conically shaped passage which terminates at a restricted opening at the lower end thereof.

* * * * *